US006318603B1

(12) United States Patent
Burt

(10) Patent No.: US 6,318,603 B1
(45) Date of Patent: Nov. 20, 2001

(54) VALVE FOR AEROSOL CONTAINER

(75) Inventor: Peter Colin Weston Burt, Ware (GB)

(73) Assignee: SmithKline Beecham Corporation, Research Triangle Park, NC (US)

( * ) Notice: Subject to any disclaimer, the term of this patent is extended or adjusted under 35 U.S.C. 154(b) by 0 days.

(21) Appl. No.: 09/446,165

(22) PCT Filed: Jun. 25, 1998

(86) PCT No.: PCT/EP98/03872

§ 371 Date: Dec. 22, 1999

§ 102(e) Date: Dec. 22, 1999

(87) PCT Pub. No.: WO99/00315

PCT Pub. Date: Jan. 7, 1999

(30) Foreign Application Priority Data

Jun. 26, 1997 (GB) ..... 9713382

(51) Int. Cl.[7] ..... B65D 83/00
(52) U.S. Cl. ..... 222/402.1; 277/945
(58) Field of Search ..... 222/402.1; 277/945

(56) References Cited

U.S. PATENT DOCUMENTS 5,450,989 * 9/1995 Gilroy ..... 222/402.1

FOREIGN PATENT DOCUMENTS 0 634 166 A 1/1995 (EP) .
0 642 992 A 3/1995 (EP) .
2713299 A 6/1995 (FR) .
2740527 A 4/1997 (FR) .

* cited by examiner

*Primary Examiner*—Philippe Derakshani
(74) *Attorney, Agent, or Firm*—Christopher P. Rogers

(57) ABSTRACT

The invention is directed to a valve for an aerosol container for dispersing a suspension or solution of a medicament in a liquid propellant contained therein. The valve comprises a valve body defining an aperture, a seal mounted at the aperture, and a valve stem having a dispensing passage. The valve stem being slidably moveable through the seal such that in a first position the valve is closed to prevent the medicament and propellant from entering the dispensing passage. The valve stem also being such that in a second position the valve is open to allow the substance to be dispensed through the dispensing passage. The valve stem characterized in that it is constructed from a mouldable plastic and a mouldable lubricant.

35 Claims, 1 Drawing Sheet

VALVE FOR AEROSOL CONTAINER

This application is filed pursuant to 35 U.S.C. § 371 as a United States National Phase Application of International Application No. PCT/EP98/03872 filed Jun, 25, 1998, which claims priorty from GB 9713382. June 26, 1997.

FIELD OF THE INVENTION

This invention relates to a valve for an aerosol container with the aid of which a quantity of the contents thereof can be dispensed. The invention has particular application to the dispensing of metered doses of medicaments, though it is applicable to the dispensing of aerosols generally.

The continuing use of aerosol formulations comprising conventional chlorofluorocarbon propellants is being debated due to the suspected role of such propellants in atmospheric depletion of ozone. Accordingly, formulations based on alternative propellants such as HFA-134a (1,1,1,2-tetrafluoroethane) and HFA-227 (1,1,1,2,3,3,3-heptafluropropane) are being developed to replace those conventional propellants thought to contribute to atmospheric ozone depletion.

Containers for aerosol formulations commonly comprise a vial body coupled to a valve. The valve comprises a valve stem through which the formulations is dispensed. Generally the valve includes a rubber valve seal intended to allow reciprocal movement of the valve stem while preventing leakage of propellant from the container.

It has been found that some conventional devices for delivering aerosols suffer impaired performance when used in connection with HRA-134a or HFA-227. Selection of suitable materials for use in valves to contain aerosol formulations based on these alternative propellants is complicated by interactions between the valve component materials and the formulation components, including the propellant. In conventional devices, particularly with some drug formulations the valve stem tends to stick, pause, or drag during the actuation cycle with the result that the user perceives a 'notchiness' as the valve stem is depressed and released. This may be partly caused by the drug to be dispensed from the container sedimenting or precipitating out of the drug-propellant suspension or solution formulation and depositing on the internal valve components, the presence of drug on the sliding interface creating increased friction during operation.

SUMMARY OF THE INVENTION

International Patent Application No. PCT/US94/06900 describes an aerosol valve wherein the rubber valve seal is made of a composition specially selected to minimize leakage of the propellant through the interface between the valve seal and valve stem upon firing. Smoothness of operation is also improved with some formulations compared to devices involving conventional thermoset rubber seals. However, although such seal compositions may improve valve performance, they do not prevent build up of deposit on the valve components, and the problem of notchiness may persist.

It is an object to provide a valve with improved smoothness of operation which alleviates the problem of valve sticking.

According to one aspect of the present invention there is provided a valve for an aerosol container for dispensing a suspension of a substance in a liquid propellant contained therein, the valve comprising a valve body defining an aperture, a seal mounted at the aperture, and a valve stem having and dispensing passage, the valve stem being slidably moveable through the seal such that in a first position the valve is closed to prevent the substance to be dispensed from entering the dispensing passage, and a in a second position the valve is open to allow the substance to be dispensed through the dispensing passage, characterised in that the valve stem is made from a material comprising lubricant.

According to another aspect of the present invention there is provided a valve stem made from a material comprising lubricant. According to a further aspect of the present invention there is provided an aerosol container comprising a valve as described herein.

BRIEF DESCRIPTION OF THE DRAWINGS

The present invention is more fully understood from the detailed description provided herein and the accompanying drawings. The drawings are provided by way of illustration only, and thus are not to be interpreted as limiting the invention.

DETAILED DESCRIPTION OF PREFERRED EMBODIMENTS OF THE INVENTION

Figure 1:
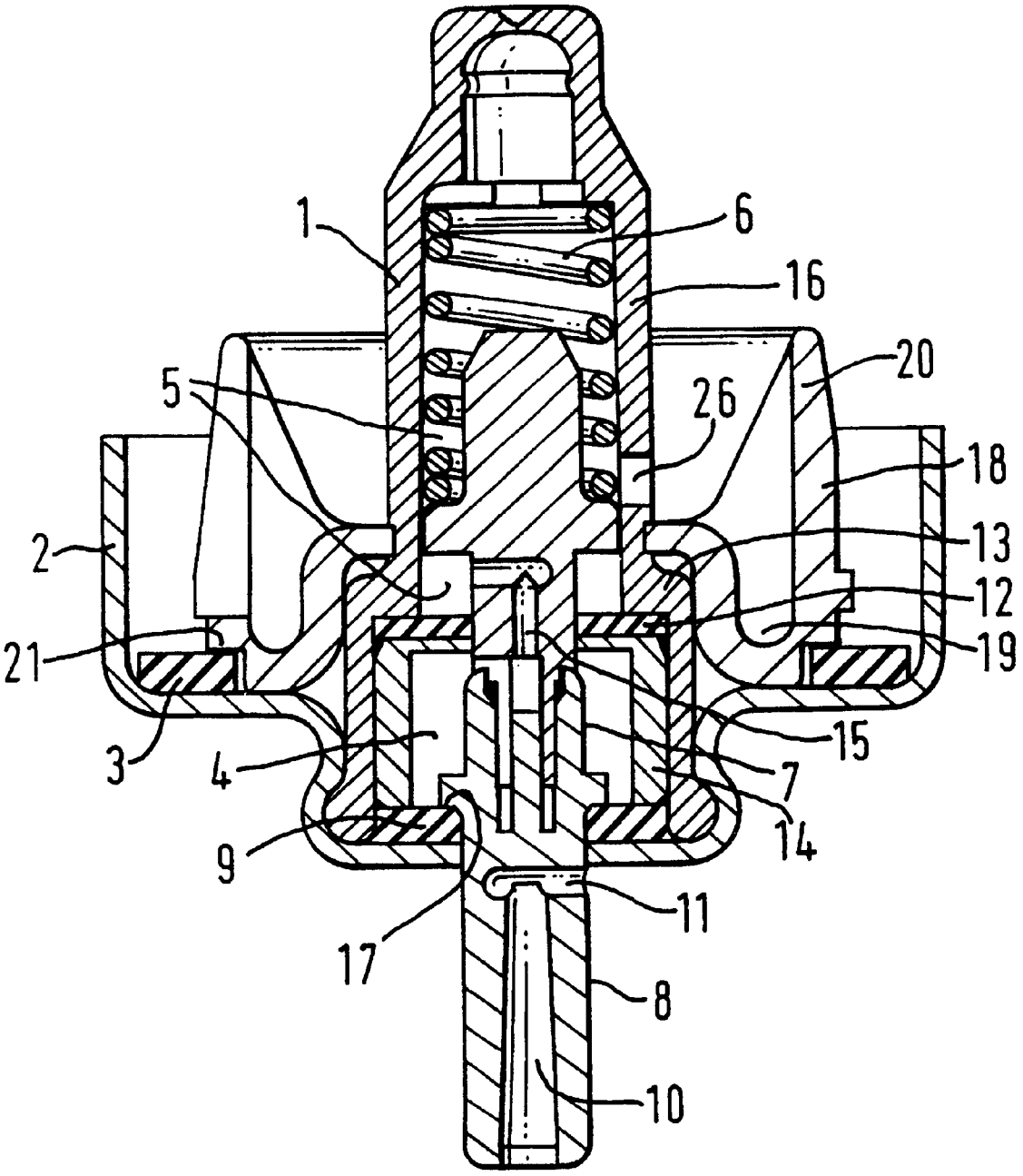
FIG. 1 shows a cross-sectional view of a preferred embodiment of the metering valve of the present invention.

Incorporating lubricant into the material of the valve stem ensures that the lubricant is comprised within the maximum area of the stem/seal contact surface, so providing improved lubrication and smoothness of operation for the life of the valve. The term 'lubricant' means any material which reduces friction between the valve stem and seal.

Suitably, the lubricant comprises a fluorine-containing polymer such as polyetrafluoroethane (PTFE), ethylenetetrafluoroethylene (ETFE), perfluoroalkoxyalkane (PFA), fluorinated ethylene propylene (FEP), vindyldionefluoride (PUDF), and chlorinated ethylene tetrafluoroethane. Preferably the lubricant comprises polyetrafluoroethane (PTFE). More preferably, the lubricant consists of polyetrafluoroethane (PTFE).

PTFE has been found to be particularly advantageous as a lubricant due to its low coefficient of friction. Furthermore, PTFE significantly reduces the problem of drug deposition on the valve stem, so removing one of the causes of valve sticking.

Suitably, the valve stem comprises up to 20% by weight of PTFE. Preferably, the valve stem comprises 5 to 10% by weight of PTFE.

PTFE can be plastic moulded and may be used effectively in small quantities constituting of the order of 5% by weight of the material of the valve stem. PTFE is also non-toxic, an important consideration for aerosol devices for dispensing medicaments.

In one aspect, the valve stem is free from any silicone material, such as silcone oil, either as a component thereof or coating thereon.

Suitably, the valve is metering valve comprising a metering chamber, a transfer passage through which a quantity of substance to be dispensed can pass from the container into the metering chamber, wherein in the first position the dispensing passage is isolated from the metering chamber and the metering chamber is in communications with the container via the transfer passage, and in the second position the dispensing passage is in communication with the metering chamber and the transfer passage is isolated from the metering chamber.

Suitably the substance to be dispensed is a medicament suspended in liquefied HFA-134a or HFA-227.

Medicaments suitable for this purpose are, for example for the treatment of respiratory disorders such as asthma, bronchitis, chronic obstructive pulmonary diseases and chest infections. Additional medicaments may be selected from any other suitable drug useful in inhalation therapy and which may be presented as a suspension. Appropriate medicaments may thus be selected from, for example, analgesics, e.g. codeine, dihydromorphine, ergotamine, fentanyl or morphine; anginal preparations, e.g. diltiazem; antiallerfics, e.g. cromoglycate, ketotifen or neodocromil; antiinfectives e.g. cephalosporins, penicillins, steptomycin, sulphonamides, tetracyclines and pentamidine; anthistamines, e.g. methapyrilene anti-inflammatories, e.g. fluticasone propionate, beclomethasone dipropionate, flunisolide, budesonide or triamcinolone acetonide; antitussives, e.g. noscapine; bronchodilators, e.g. salmeterol, salbutamol, ephedrine, adrenaline, fenoterol, formoterol, isoprenaline, metraproterenol, phenylephrine, phenylpropanolamine, pirbutero, reproterol, rimiterol, terbutaline, isoetharine, tulobuterol orciprenaline, or (-)-4-amino-3,5-dichloro-α-[[[6-[2-(2-pyridinyl)ethoxy]-hexyl]amino]methyl] benzenemethanol; diuretics, e.g. amiloride; anticholinergics e.g. ipratropium, atropine or oxitropium; hormones, e.g. cortisone, hydrocortisone or prednisolone; xanthines e.g. aminophylline, choline theophyllinate, lysine theophyllinate or theophylline and therapeutic proteins and peptides, e.g. insulin or glucagon. It will be clear to a person skilled in the art that, where appropriate, the medicaments may be used in the form of salts (e.g. as alkali metal or amine salts or as acid addition salts) or as esters (e.g. lower alkyl esters) or as solvates (e.g. hydrates) to optimise the activity and/or stability of the medicament. Preferred medicaments are salbutamol, salbutamol sulphate, salmeterol, salmeterol xinafoate, fluticasone propionate, beclomethasone dipropionate and terbutaline sulphate. It is to be understood that the suspension or solution of medicament may consist purely of one or more active ingredients.

Preferably the medicament is salmeterol xinafoate, fluticasone propionate or a combination thereof.

This invention will now be described further with reference to the accompanying drawing in which FIG. 1 is a section through a metering valve according to the invention.

A valve according to the invention is shown in FIG. 1 and comprises a valve body 1 sealed in a ferrule 2 by means of crimping, the ferrule itself being set on the neck of a container (not shown) with interposition of a gasket 3 in a well-known manner. The container is filled with a suspension of salmeterol xinafoate in liquid propellant HFA134a.

The valve body 1 is formed at its lower part with a metering chamber 4, and its upper part with a sampling chamber 5 which also acts as a housing for a return spring 6. The words "upper" and "lower" are used for the container when it is in a use orientation with the neck of the container and valve at the lower end of the container which corresponds to the orientation of the valve as shown in FIG. 1. Inside the valve body 1 is disposed a valve stem 7, a part 8 of which extends outside the valve through lower stem seal 9 and ferrule 2. The stem part 8 is formed with an inner axial or longitudinal canal 10 opening at the outer end of the stem and in communication with a radial passage 11.

The upper portion of stem 7 has a diameter such that it can pass slidably through an opening in an upper stem seal 12 and will engage the periphery of that opening sufficiently to provide a seal. The stem is made form HOSTAFORM X329™ (Hoechst), which is moulded in a conventional manner. Significantly, HOSTAFORM comprises 5% PTFE, which has the effect of reducing the friction between the valve stem and stem seals 9 and 12 during actuation, as explained below, PTFE also has the effect of reducing any build up of drug deposition on the surface of the valve stem, the presence of which on the sliding interface between the valve stem and seal could otherwise cause increased friction during actuation. Upper stem seal 12 is held in position against a step 13 formed in the valve body 1 between the said lower and upper parts by a sleeve 14 which defines the metering chamber 4 between lower stem seal 9 and upper stem seal 12. The valve stem 7 has a passage 15 which, when the stem is in the inoperative position shown, provides a communication between the metering chamber 4 and sampling chamber 5, which itself communicates with the interior of the container via orifice 16 formed in the side of the valve body 1.

Valve stem 7 is biased downwardly to the inoperative position by return spring 6 and is provided with a shoulder 17 which abuts against lower stem seal 9. In the inoperative position as shown in FIG. 1 shoulder 17 abuts against lower stem seal 9 and radial passage 11 opens below lower stem seal 9 so that the metering chamber 4 is isolated from canal 10 suspension inside cannot escape.

A ring 18 having a "U" shaped cross section extending in a radial direction is disposed around the valve body orifice 16 so as to form a trough 19 around the valve body. As seen in FIG. 1 the ring is formed as a separate component having an inner annular contacting rim of a diameter suitable to provide a friction fit over the upper part of valve body 1, the ring seating against step 13 below the orifice 16. However, the ring 18 may alternatively be formed as an integrally moulded part of valve body 1.

To use the device the container is first shaken to homogenise the suspension within the container The user then depresses the valve stem 7 against the force of the spring 6. When the valve stem is depressed both ends of the passage 15 come to lie on the side of upper stem seal 12 remote from the metering chamber 4. Thus a dose is metered within the metering chamber. Continued depression of the valve stem will move the radial passage 11 into the metering chamber 4 while the upper stem seal 12 seals against the valve stem body. Thus, the metered dose can exit through the radial passage 11 and outlet canal 10.

Releasing the valve stem causes it to return to the illustrated position under the force of the spring 6. The passage 15 then once again provides communication between the metering chamber 4 and sampling chamber 5. Accordingly, at this stage liquid passes under pressure from the container through orifice 16, through the passage 15 and thence into the metering chamber 4 to fill it.

It will be understood that the present disclosure is for the purpose of illustration only and the invention extends to modifications, variations and improvements thereto.

What is claimed is:

1. A valve for use with an aerosol container for dispensing a suspension or solution of a medicament in a liquid propellant contained therein, the valve comprising:

a valve body defining a metering chamber, one or more gaskets suitable for slidingly engaging a valve stem, and the valve stem constructed from a mouldable plastic and one or more flurocarbon polymers, having a dispensing passage, and in communication with the metering chamber.

2. The valve according to claim 1, wherein the one or more fluorocarbon polymers comprises a polyetrafluoroethane.

3. The valve according to claim 2, wherein the one or more flurocarbon polymers comprises about 5 to 10% by weight of polyetrafluoroethane.

4. The valve according to claim 1, wherein the one or more flurocarbon polymers are selected from the group consisting of polyetrafluoroethane, ethylenetetrafluoroethylene, perfluoroalkoxyalkane, fluorinated ethylene propylene, vinyldionefluoride, chlorinated ethylene tetrafluoroethylene and combinations thereof.

5. A metering device comprising:

a container in communication with a metering chamber, a valve stem constructed from a mouldable plastic and one or more flurocarbon polymers, the stem having a transfer passage adapted to dispense a quantity of an aerosol drug formulation comprising a medicament and a propellant, and, a valve body defining the metering chamber, one or more gaskets adapted to slidingly engage the valve stem.

6. The device according to claim 5, wherein the aerosol drug formulation includes one or more medicaments suspended in the liquid propellant, and wherein the liquid propellant is selected from the group consisting of 1,1,1,2-tetrafluoroethane, 1,1,1,2,3,3-heptafluoropropane, and mixtures thereof.

7. The device according to claim 6, wherein the medicament is a member selected from the group consisting of salmeterol, fluticasone, salbutamol, beclomethasone, terbultaline, salts, esters and solvates thereof, and combinations thereof.

8. The valve according to claim 1, wherein the medicament is selected from the group consisting of a respiratory disorder medicament, an analgesic, an anginal preparation, an antiallergic, an antiinfective, an antihistamine, an anti-inflammatory, an antitussive, a bronchodilator, a diuretic, an anticholinergic, a hormone, a xanthine, a therapetuic protein, a therapeutic peptide and combinations thereof.

9. The valve according to claim 1, wherein the valve is suitable for dispensing an aerosol formulation comprising the medicament suspended in the liquid propellant, and wherein the medicament is selected from the group consisting of salmeterol, fluticasone, salbutamol, beclomethasone, terbutaline, salts, esters and solvates thereof, and combinations thereof.

10. The valve according to claim 9, further including a sampling chamber in communication with the metering chamber.

11. The valve according to claim 10, further including a sleeve within the valve body further defining the metering chamber.

12. The valve according to claim 11, further including a ring having a trough adapted to frictionally engage the valve body.

13. The valve according to claim 12 further including a return spring adapted to bias the valve stem.

14. The valve according to claim 9, wherein the propellant is selected from the group consisting of 1,1,1,2-tetrafluroethane, 1,1,1,2,2,3,3-heptafluropropane, and combinations thereof.

15. The valve according to claim 9, wherein the medicament is salmeterol xinafoate and the propellant is 1,1,1,2-tetrafluroethane.

16. The valve according to claim 9, wherein the medicament is a combination of fluticasone propionate and salmeterol xinafoate, and the propellant is 1,1,1,2-tetrafluroethane.

17. The valve according to claim 9, wherein the medicament is fluticasone propionate and the propellant is 1,1,1,2-tetrafluroethane.

18. The valve according to claim 9, wherein the medicament is salbutamol sulphate and the propellant is 1,1,1,2-tetrafluroethane.

19. The valve according to claim 9, wherein the medicament is beclomethasone dipropionate and the propellant is 1,1,1,2-tetrafluorethane.

20. The device according to claim 7, further including a sampling chamber in communication with metering chamber.

21. The device according to claim 20, further including a sleeve within the valve body further defining the metering chamber.

22. The device according to claim 21, further including a ring having a trough adapted to frictionally engage the valve body.

23. The device according to claim 22 further including a return spring adapted to bias the valve stem.

24. The device according to claim 5, wherein the medicament is suspended in the propellant, and wherein the propellant is selected from the group consisting of 1,1,2-tetrafluroethane, 1,1,1,2,3,3-heptafluropropane, and combinations thereof.

25. The device according to claim 23, wherein the medicament is salmeterol xinafoate and the propellant is 1,1,1,2-tetrafluoroethane.

26. The device according to claim 23, wherein the medicament is a combination of fluticasone propionate and salmeterol xinafoate, and the propellant is 1,1,1,2-tetrafluoroethane.

27. The device according to claim 23, wherein the medicament is fluticasone propionate and the propellant is 1,1,1,2-tetrafluroethane.

28. The device according to claim 23, wherein the medicament is salbutamol sulphate and the propellant is 1,1,1,2-tetrafluroethane.

29. The device according to claim 23, wherein the medicament is beclomethasone dipropionate and the propellant is 1,1,1,2-tetrafluoroethane.

30. A valve stem comprising:

a mouldable plastic, and one or more mouldable flurocarbon polymers.

31. The valve stem of claim 30, wherein the stem is suitable for dispensing an aerosol drug formulation comprising a medicament and a propellant, wherein the drug is selected from the group consisting of salmeterol, fluticasone, salbutamol, beclomethasone, terbutaline, salts, esters and solvates thereof, and combinations thereof, and wherein the propellant is selected from the group consisting of 1,1,1,2-tetrafluoroethane, 1,1,1,2,3-heptafluoropropane, and combinations thereof.

32. The valve stem of claim 30 comprising up to 20% by weight of the one or more mouldable flurocarbon polymers.

33. The valve stem of claim 30 comprising 5 to 10% by weight of the one or more mouldable flurocarbon polymers.

34. The valve stem of claim 30, wherein the one or more mouldable fluorocarbon polymers are selected from the group consisting of polyetrafluoroethane, ethylenetetrafluoroethylene, perfluoroalkoxyalkane, fluorinate ethylene propylene, vinyldionefluoride, chlorinated ethylene tetrafluoroethylene and combinations thereof.

35. A valve for use with an aerosol container for dispensing a suspension or solution of a medicament in a liquid propellant contained therein, the valve comprising:

a valve body defining an aperture, and a valve stem constructed from one or more mouldable plastics and one or more flurocarbon polymers and having a dispensing passage, the valve stem adapted to slidingly engage a means for sealing the valve stem from the valve body.

* * * * *